US012012856B2

(12) United States Patent
Vallati

(10) Patent No.: US 12,012,856 B2
(45) Date of Patent: Jun. 18, 2024

(54) ROCK BOLT ASSEMBLY COMPRISING A SENSOR ASSEMBLY

(71) Applicants: SANDVIK MINING AND CONSTRUCTION TOOLS AB, Sandviken (SE); SANDVIK MINING AND CONSTRUCTION AUSTRALIA (PRODUCTION/SUPPLY) PTY LTD, Milton (AU)

(72) Inventor: Osvaldo Vallati, Heatherbrae (AU)

(73) Assignees: SANDVIK MINING AND CONSTRUCTION TOOLS AB, Sandviken (SE); SANDVIK MINING AND CONSTRUCTION AUSTRALIA PTY LTD, Milton (AU)

( * ) Notice: Subject to any disclaimer, the term of this patent is extended or adjusted under 35 U.S.C. 154(b) by 99 days.

(21) Appl. No.: 17/786,689

(22) PCT Filed: Dec. 18, 2020

(86) PCT No.: PCT/EP2020/086991
§ 371 (c)(1),
(2) Date: Jun. 17, 2022

(87) PCT Pub. No.: WO2021/123140
PCT Pub. Date: Jun. 24, 2021

(65) Prior Publication Data

US 2023/0023293 A1 Jan. 26, 2023

(30) Foreign Application Priority Data

Dec. 20, 2019 (EP) ..... 19218824

(51) Int. Cl.
*E21F 17/18* (2006.01)
*E21D 21/00* (2006.01)

(52) U.S. Cl.
CPC ..... *E21D 21/0093* (2013.01); *E21D 21/0033* (2013.01); *E21F 17/185* (2013.01)

(58) Field of Classification Search
CPC .. E21F 17/185; E21D 21/003; E21D 21/0033; E21D 21/0093
(Continued)

(56) References Cited

U.S. PATENT DOCUMENTS 2,725,843 A * 12/1955 Francis ..... E21F 17/185 411/548
3,646,553 A * 2/1972 Conkle ..... E21F 17/185 411/548
(Continued)

FOREIGN PATENT DOCUMENTS

CZ 25706 U1 7/2013

*Primary Examiner* — Sunil Singh
(74) *Attorney, Agent, or Firm* — Corinne R. Gorski

(57) ABSTRACT

A sensor assembly for a rock bolt, wherein the rock bolt includes a central rod, a split tube and a wedge anchor assembly fitted around the central rod, a rock plate, and a nut for attachment to an outer end of the central rod. The sensor assembly includes a distance sensor, a bracket for attaching the distance sensor to an outer portion of the split tube, an elongate spacing member configured to be fitted around the split tube between the nut and the rock plate to keep the nut and the rock plate spaced apart. The spacing member has an opening extending along at least a portion of the length thereof, the opening being sized large enough to allow movement of the bracket along a portion of the length of the spacing member with the distance sensor attached to the outer portion of the split tube by the bracket.

15 Claims, 2 Drawing Sheets

(58) Field of Classification Search
USPC ..... 405/259.1–259.4; 73/761, 784
See application file for complete search history.

(56) References Cited

U.S. PATENT DOCUMENTS

| | | | | |
|---|---|---|---|---|
| 4,136,556 | A * | 1/1979 | Graham | E21F 17/185 73/781 |
| 4,156,236 | A * | 5/1979 | Conkle | E21D 21/0093 405/259.1 |
| 5,185,595 | A | 2/1993 | Friesen | |
| 5,284,107 | A | 2/1994 | Milne et al. | |
| 2017/0058672 | A1 | 3/2017 | Abreu | |

* cited by examiner

ROCK BOLT ASSEMBLY COMPRISING A SENSOR ASSEMBLY

RELATED APPLICATION DATA

This application is a § 371 National Stage Application of PCT International Application No. PCT/EP2020/086991 filed Dec. 18, 2020, claiming priority to EP 19218824.1 filed Dec. 20, 2019.

TECHNICAL FIELD

The present disclosure relates to rock bolts for reinforcement of formations, such as rock strata, and specifically to technology for monitoring such bolts over time to detect rock movement.

BACKGROUND

Formations, such as rock formations or rock strata, are often reinforced using rock bolts. For example, rock bolts are commonly used for reinforcement of tunnel roofs and for stabilization of rock walls, slopes and dikes. Various types of rock bolts or anchors are used depending for example on the type of formation to be reinforced.

A common type of rock bolt is the hydraulically expandable rock bolt provided with an expandable body to be driven into a formation and thereafter expanded by introduction of a pressurized pressure medium such that the expandable body presses against the wall of the borehole and thereby engages the formation. A hydraulically expandable rock bolt is known from CZ 25706 U1.

Another type of rock bolt is the friction bolt. Such a rock bolt may be driven into a formation by a driving device such as a jumbo. The mechanically expandable bolt comprises an elongate expandable outer body, sometimes referred to as a split tube, and a central rod extending inside the outer body from a trailing portion provided with a nut to a leading portion operatively connected to an expansion mechanism for expanding the outer body upon rotation of the central rod.

At installation of the mechanically expandable rock bolt in the formation, the driving device is operated to repeatedly impact the outer body of the bolt, thereby forcing the outer body into the formation. When the bolt is sufficiently far driven into the formation the bolt is expanded by rotation of the nut, which causes rotation of the central rod such that the expansion mechanism causes expansion of the outer body. The nut may be a blind nut such that the nut can first be screwed onto a thread at the trailing portion of the central rod, wherein the central rod eventually bottoms out in the blind nut, thereby preventing further relative rotation between the central rod and the blind nut. This allows torque to be applied to the nut and further to the central rod for tensioning of the expansion mechanism of the bolt. Other means for preventing co-rotation between the central rod and nut are feasible, such as thread-locking fluid or a shearing pin, wherein a standard nut with through hole may be used instead of a blind nut.

Ground movements may cause cracks in the rock and the bolt(s) thus prevent pieces of rock from falling apart. However, when rock cracks, the load on a bolt may increase and the bolt may be stretched, thereby increasing the risk of unwanted further rock movements and rock bolt failure.

SUMMARY

An object of the invention is to enable detection of rock movement such that proper measures can be taken early on in response to rock movements. According to a first aspect of the invention, this object is achieved by the inventive sensor assembly for a rock bolt as defined in the appended independent claim 1, with alternative embodiments defined in the dependent claims. The sensor assembly is for a rock bolt comprising a central rod, a split tube for being fitted around the central rod, a wedge anchor assembly fitted to the central rod, a rock plate with a hole, a nut for attachment to an outer end of the central rod and a washer for use with the nut. The sensor assembly comprises: a distance sensor, a bracket for attaching the distance sensor to an outer portion of the split tube, an elongate spacing member configured to be fitted around the split tube between the nut and the rock plate to keep the nut and the rock plate spaced apart. The spacing member comprises an opening extending along at least a portion of the length of the spacing member, wherein the opening is sized large enough to allow movement of the bracket along a portion of the length of the spacing member with the distance sensor attached to the outer portion of the tube by the bracket.

Upon mounting of the rock bolt to a rock or other formation, the spacing member is fitted between the washer and the rock plate. Then, the nut is rotated to cause anchoring of the bolt by tightening of the wedge anchor assembly. Once the rock bolt is anchored, the bracket and distance sensor are attached to the split tube with the bracket extending through the opening. The distance sensor is configured to measure the distance to the rock plate but could alternatively in other embodiments measure the distance to an object provided at a known and static distance from the rock plate. Upon changes in the rock formation, the rock may force the rock plate outwards whilst an inner portion of the split tube remains firmly attached further into the rock/formation, causing the central rod to deform by longitudinal extension. At such extension of the central rod, the split tube remains substantially static whilst the rock plate moves outwards together with the spacing member. The distance between the distance sensor and the rock plate is thus reduced since the bracket remains static while the spacing member moves outwards with the rock plate. We are discussing about relative movements.

The sensor assembly may further comprise a first unit configured to receive readings from the distance sensor and emit a signal based on the readings from the distance sensor. The provision of such a first unit enables broadcasting of information based on the readings such that other entities are enabled to remotely listen for the emitted signal and use the information in the signal for initiating appropriate measures to decrease the risk of unwanted further rock movements and rock bolt failure.

The first unit may be configured to monitor the readings over a period of time and wherein the signal emitted is indicative of a change in readings monitored over said period of time exceeding a predetermined threshold. Hence, the first signal may have an active role in monitoring and interpreting the readings over time wherein the signal emitted is based on local interpretation based on local circumstances. This simplifies the design of the listening systems such that tracking may be performed locally at each bolt rather than centrally. Hence, different bolts could use different interpretation tactics based on for example their individual dimension and material or based on the material of the rock in which they are mounted.

The sensor assembly may further comprise a base unit configured to be attachable to the nut, wherein the base unit comprises a housing configured to contain the first unit. The base unit protects the first unit and holds it to the nut.

The sensor assembly may further comprise an antenna extending outside the housing, wherein the antenna is connected to the first unit. The provision of antenna outside the housing enables increased signal strength and enables redirection of the antenna upon mounting of the sensor assembly to the rock bolt such that the antenna is directed in an advantageous direction.

The distance sensor may be an ultrasonic sensor or a laser sensor. Such sensors are readily available at low cost and are robust and reliable.

The spacing member may be cylindrical. The cylindrical shape is easy to manufacture and allows rotation about the central rod thereby enabling easier assembly on the rock bolt.

The opening of the cylindrical spacing member may be an elongate slot extending along the spacing member. The elongate slot is easy to manufacture, for example by milling or by extrusion.

A front portion of the spacing member may be provided with a chamfered seating portion configured to fit with the hole of the rock plate to align the spacing member with respect to the rock plate. The provision of the chamfered seating portion thus enables improved load distribution.

The bracket may be provided with attachment means for attachment to the split tube. The attachment means enables separate handling of the sensor until installation of the bolt has finished, such that the sensor does not have to be present during impact driving of the rock bolt into the rock.

The attachment means may comprises a screw. Screws are readily available and can easily be unscrewed and refitted for service of the sensor.

The distance sensor may be an analogue sensor such as a dial gauge or a ruler. The analogue sensor works in harsh environments with a lot of electric interference and thus provides for a robust fall back should the electronic sensors fail. Some bolts could be provided with analogous sensors and nearby sensors with digital sensors. Also, an analogue gauge or ruler could be provided complimentary to a digital sensor in one and the same rock bolt assembly.

The sensor assembly may further comprise an alignment means configured to rotationally align the split tube and the spacing member about the longitudinal axis of the central rod bolt. For example, the alignment means could comprise a protrusion extending from either the spacing member or from the split tube, and a matching recess in the other one of the split tube and the spacing member respectively. The protrusion could be integrally formed with the spacing member or the split tube, or the key could be a separate part positioned between them. If the key is a separate part, a corresponding recess may be provided in both the split tube and in the spacing member to keep them aligned when the key is positioned within both recesses. By rotationally aligning the spacing member and the split tube, the position on the split tube where the bracket is to be attached/is attached, is always aligned with the opening of the split tube through which the bracket is to extend in use. Thus, the alignment is useful at mounting of the bracket and further ensures that the bracket is not squeezed or damaged by the spacing member at rotation of the nut.

A second aspect of the invention relates to a rock bolt assembly comprising the sensor assembly and the rock bolt as described above.

The outer end portion of the split tube may be provided with a hole configured for engagement by the screw.

A third aspect of the invention relates to a ground support monitoring system comprising a plurality of sensor assemblies as described above and a monitoring unit configured to receive data emitted by the first units of the plurality of sensor assemblies. The monitoring unit is also configured to either relay the received data to a recipient or analyze the received data by monitoring sensor readings over a period of time and emit a signal indicative of a change in readings monitored over said period of time exceeding a predetermined threshold. Hence, the monitoring system connects a plurality of sensors to a central monitoring unit which can be differently configured depending on local requirements. For example, the central unit can locally process data or it can relay/forward it to a recipient, such as a remote monitoring system gathering data from many geographical sites. The provision of a monitoring unit enables one type of signal to be used between the monitoring unit and the first units of each rock bolt and another type of signal to be used for communicating to outside systems, thereby enabling one type of signal underground for short range transfer in complex surroundings and another type of signal for communication with a remote site.

DETAILED DESCRIPTION

Figure 1:
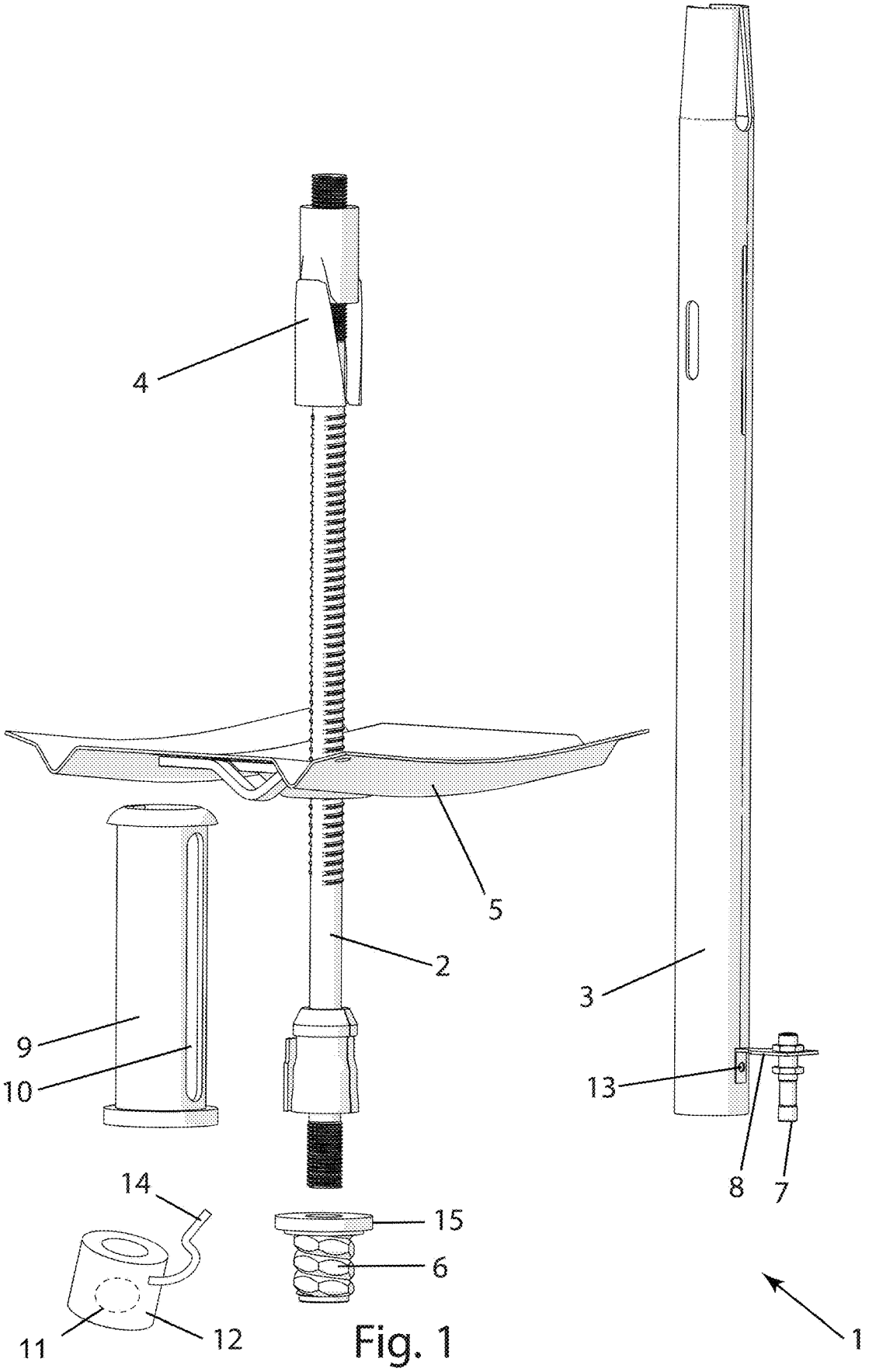
FIG. 1 shows an exploded perspective view of a rock bolt assembly comprising a sensor assembly according to a first embodiment.

A sensor assembly 1 according to a first embodiment will hereinafter be described with reference to the appended drawings.

The sensor assembly 1 is suitable for use with a rock bolt comprising a central rod 2, a split tube 3 for being fitted around the central rod 2, a wedge anchor assembly 4 fitted to the central rod 2, a rock plate 5 with a hole, and a nut 6 for attachment to an outer end of the central rod 2. The rock bolt is mounted to a formation as known in the art by drilling a hole in the formation, inserting the rock bolt, and rotating the nut 6 of the rock bolt to thereby rotate the central rod 2. The wedge anchor assembly 4 causes the rock bolt to be anchored in the formation upon tensioning of the wedge mechanism at rotation of the central rod 2.

A driver socket (not shown) is used in known manner to hammer the rock bolt into the formation, and the driver socket is subsequently rotated to apply a momentum to the nut 6 at the end of the rock bolt. In the present invention, the sensor assembly 1 is provided for enabling monitoring of elongation of the rock bolt over time which may occur if the rock cracks where the rock bolt is installed such that an outer piece of the rock moves outwards from an inner piece of rock in which the rock bolt is anchored.

The sensor assembly 1 thus enables detection of rock movement such that proper measures can be taken early on including for example further strengthening of the rock, exchange of bolts or controlled removal of loose pieces of rock.

The sensor assembly 1 comprises: a distance sensor 7, a bracket 8 for attaching the distance sensor 7 to an outer portion of the split tube 3, an elongate spacing member 9 configured to be fitted around the split tube 3 between the nut 6 and the rock plate 5 to keep the nut 6 and the rock plate 5 spaced apart. The spacing member 9 comprises an opening 10 extending along a portion of the length of the spacing member 9. The opening is sized large enough to allow movement of the bracket 8 along a portion of the length of the central rod 2 with the distance sensor 7 attached to the outer portion of the split tube 3 by the bracket 8. In other embodiments, the opening may alternatively extend along the full length of the spacing member 9.

Figure 2:
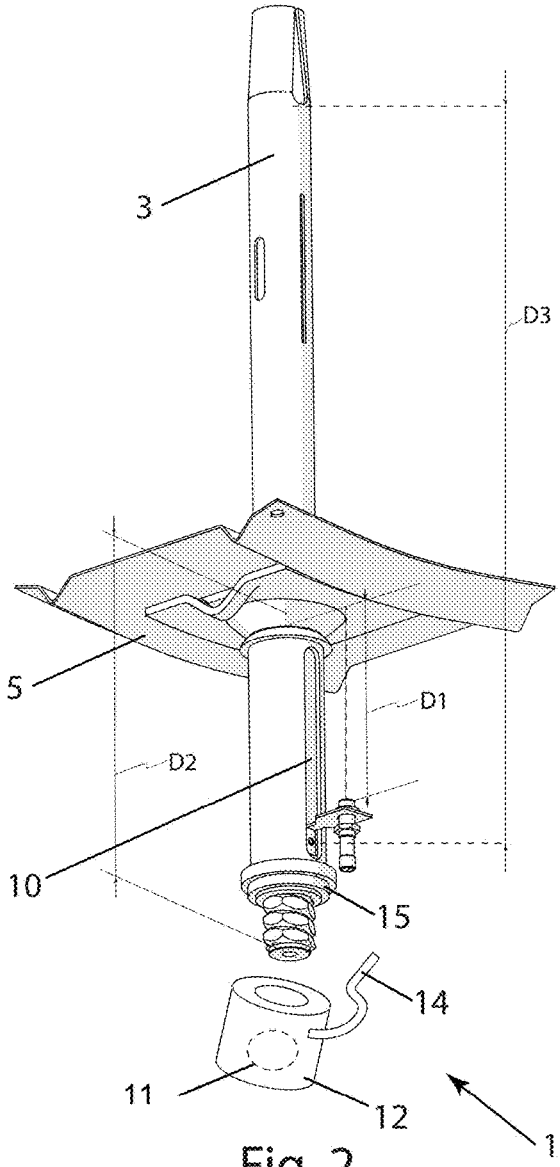
FIG. 2 shows a perspective view of the rock bolt assembly of FIG. 1 as installed in rock (rock not shown) before subsequent crack and movement of rock.

Once the rock bolt is anchored, the bracket 8 and distance sensor 7 are attached to the split tube 3 with the bracket 8 extending through the opening 10. As shown in FIGS. 1 and 2, the distance sensor 7 is configured to measure a first distance D1 to the rock plate but could alternatively in other embodiments measure the distance to an object provided at a known and static distance from the rock plate 5. Upon changes in the rock formation, the rock may force the rock plate 5 outwards whilst the split tube 3 remains firmly attached to the rock/formation, causing the central rod 2 to deform by longitudinal extension wherein the first distance D1 is reduced as evident when comparing it in FIG. 1 (before elongation of central rod) and FIG. 2 (after elongation of central rod). FIGS. 1 and 2 also show that the length of the length D2 from the rock plate 5 to the nut 6 is static and that the length D3 of the split tube 3 is static. Hence, at elongation of the central rod 2, the split tube 3 remains substantially static (is not elongated) whilst the rock plate 5 moves outwards. The first distance D1 between the distance sensor 7 and the rock plate 5 is thus reduced since the bracket 8 remains static while the spacing member 9 moves outwards with the rock plate 5. Again, we are discussing relative movements.

The sensor assembly 1 also comprises a first unit 11 configured to receive readings from the distance sensor 7 and emit a signal based on the readings from the distance sensor 7. The provision of such a first unit 11 enables broadcasting of information based on the readings such that other entities are enabled to remotely listen for the emitted signal and use the information in the signal for initiating appropriate measures to decrease the risk of unwanted further rock movements or rock bolt failure. In other embodiments, the first unit 11 may alternatively be omitted wherein readings have to be collected from each distance sensor 7 by any other suitable means such as by a wired/direct connection.

The first unit 11 is configured to monitor the readings over a period of time and the signal emitted is indicative of a change in readings monitored over said period of time exceeding a predetermined threshold. Hence, the first unit has an active role in monitoring and interpreting the readings over time wherein the signal emitted is based on local interpretation based on local circumstances. This simplifies the design of any listening systems, reduces the need of transmission of data for analysis, and enables monitoring to be performed locally at each bolt rather than remotely. Hence, different bolts could use different interpretation tactics based on for example their individual dimension and material or based on the local material characteristics or importance of stability of the rock in which they are mounted.

Figure 3:
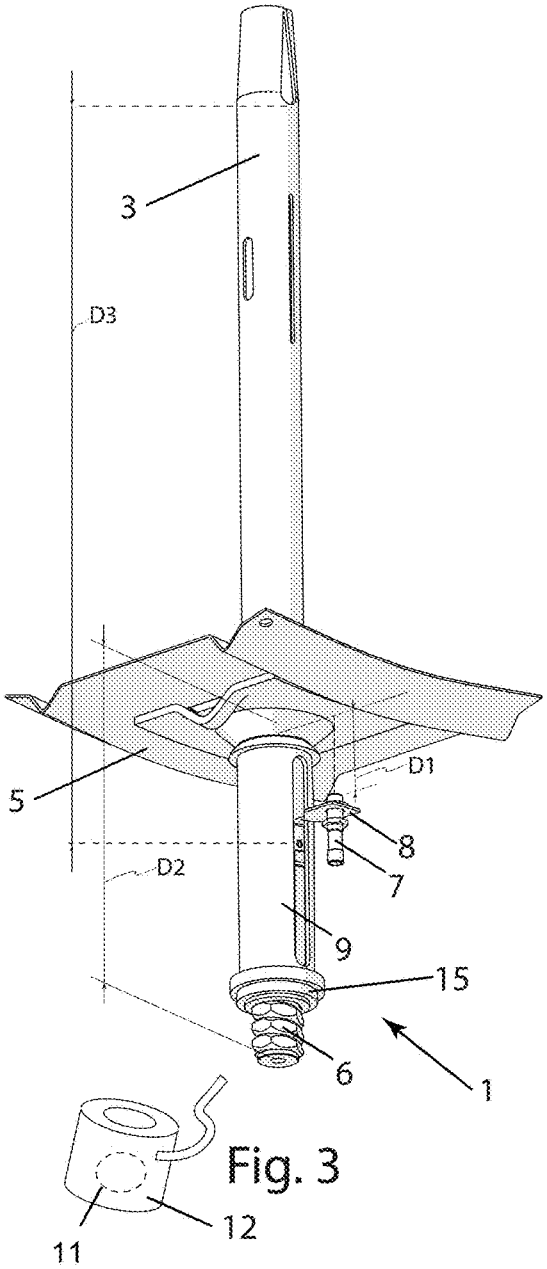
FIG. 3 shows a perspective view of the rock bolt assembly of FIG. 2 as installed in rock (rock not shown) but after subsequent crack and movement of rock causing elongation of the central rod of the rock bolt. Hence, the distance D1 is smaller than in FIG. 2.
Figure 4:
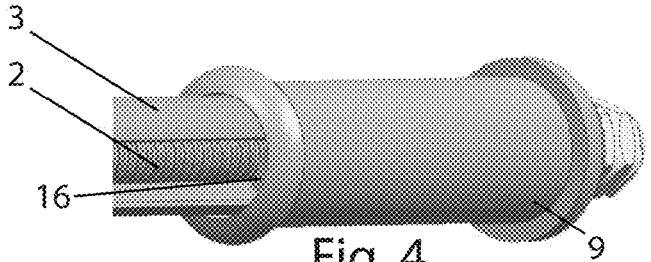
FIG. 4 shows an end portion of the bolt (rock plate not illustrated) with the alignment means for rotationally aligning the spacing member and the split tube.

As shown in FIGS. 1-3, the sensor assembly 1 further comprises a base unit 12 configured to be attachable to the nut 6. The base unit 12 comprises a housing configured to contain the first unit 11. The base unit 12 protects the first unit 11 and holds it to the nut 6. Here, the base unit 12 is connected to the distance sensor 7 by means of a physical cable 14 such that the signal between the readings from the distance sensor are transmittable to the first unit by the cable 14. Further, the use of a cable 14 provides a physical link such that the first unit and the base unit cannot accidently fall apart from the distance sensor upon installation or service. Also, a battery for powering the distance sensor 7 is provided within the base unit 12 and the power transmitted to the distance sensor 7 through the cable 14. The base unit 12 is provided with a central recess configured to fit to the nut 6 by friction/press fit. In other embodiment, the central recess of the base unit 12 is provided with a thread for engaging the large outer thread of the nut shown in the figures.

The sensor assembly 1 also comprises an antenna (not illustrated) inside the housing. However, the antenna may in other embodiments extend outside the housing. The antenna is connected to the first unit to transmit its signals.

The distance sensor 7 is an ultrasonic sensor but may alternatively be a laser sensor or any other suitable sensor. Further, the distance sensor 7 may alternatively be an analogue sensor such as a dial gauge or a ruler. If an analogue sensor is used, is requires manual inspection or visual inspection by camera, for example a camera mounted on a robot automatically inspecting the dial or gauge at regular intervals.

The spacing member 9 is cylindrical and is provided with an elongate slot extending along the spacing member 9. The said slot defines the opening 10 for the bracket to move along.

A front portion of the spacing member 9 is provided with a chamfered seating portion configured to fit with the hole of the rock plate 5 to align the spacing member 9 with respect to the rock plate 5. In other embodiments, the front portion may have any other suitable shape such as planar or rounded.

The bracket 8 is provided with attachment means in the form of a screw for attaching the bracket 8 to the split tube. In other embodiments, any other suitable attachment means may be used to attach the bracket 8 to the split tube, such as a rivet, an adhesive, a weld, or a mechanical fastener such as a push button. In other embodiments, the bracket 8 may be integrated with the split tube.

The second aspect of the invention relates to a rock bolt assembly comprises the sensor assembly 1 and the rock bolt described above.

The outer end portion of the split tube 3 is provided with a hole configured for engagement by the screw 13. In alternative embodiments, no hole is provided, wherein a hole may have to be manually added at installation of the rock bolt or alternative means for attaching the distance sensor/bracket to the split tube used.

The third aspect of the invention relates to a ground support monitoring system comprising a plurality of sensor assemblies 1 as described above and a monitoring unit (not illustrated) configured to receive data emitted by the first units 11 of the plurality of sensor assemblies 1. The monitoring unit is also configured to either relay the received data to a recipient or analyze the received data by monitoring sensor readings over a period of time and emit a signal indicative of a change in readings monitored over said period of time exceeding a predetermined threshold. The monitoring unit may be implemented in the form of a computer system operating a software designed to perform the above-mentioned functions of the monitoring unit. The monitoring unit may be provided remotely from the first units as long as the monitoring system is able to receive the data emitted by the first units 11.

The invention claimed is:

1. A rock bolt assembly comprising:

a sensor assembly; and a rock bolt, the rock bolt including a central rod, a split tube fitted around the central rod, a wedge anchor assembly fitted to the central rod, a rock plate having a hole, a nut for attachment to an outer end of the central rod, and a washer for use with the nut, the sensor assembly including a distance sensor, a bracket arranged for attaching the distance sensor to an outer portion of the split tube, an elongate spacing member configured to be fitted around the split tube between the washer and the rock plate to keep the nut and the rock plate spaced apart, wherein the spacing member includes an opening extending along at least a portion of a length of the spacing member, wherein the opening is sized large enough to allow movement of the bracket along a portion of the length of the spacing member with the distance sensor attached to the outer portion of the split tube by the bracket.

2. The rock bolt assembly according to claim 1, further comprising a first unit configured to receive readings from the distance sensor and emit a signal based on the readings from the distance sensor.

3. The rock bolt assembly according to claim 2, wherein the first unit is configured to monitor the readings over a period of time and wherein the signal emitted is indicative of a change in readings monitored over said period of time exceeding a predetermined threshold.

4. The rock bolt assembly according to claim 2, further comprising a base unit configured to be attachable to the nut, wherein the base unit includes a housing configured to contain the first unit.

5. The rock bolt assembly according to claim 4, further comprising an antenna extending outside the housing, wherein the antenna is connected to the first unit.

6. The rock bolt assembly according to claim 2, wherein the distance sensor is an ultrasonic sensor or a laser sensor.

7. The rock bolt assembly according to claim 1, wherein the spacing member is cylindrical.

8. The rock bolt assembly according to claim 7, wherein the opening of the cylindrical spacing member is an elongate slot extending along the spacing member.

9. The rock bolt assembly according to claim 1, wherein a front portion of the spacing member is provided with a chamfered seating portion configured to fit with the hole of the rock plate to align the spacing member with respect to the rock plate.

10. The rock bolt assembly according to claim 1, wherein the bracket is provided with an attachment device for attaching the bracket to the split tube.

11. The rock bolt assembly according to claim 10, wherein the attachment device is a screw.

12. The rock bolt assembly according to claim 11, wherein the outer portion of the split tube is provided with a hole configured for engagement by the screw.

13. The rock bolt assembly according to claim 1, wherein the distance sensor is an analogue sensor.

14. The rock bolt assembly according to claim 1, further comprising an alignment means configured to rotationally align the split tube and the spacing member about the longitudinal axis of the central rod bolt.

15. A ground support monitoring system comprising:

a plurality of rock bolt assemblies according to claim 1;

a monitoring unit configured to receive data emitted by first units of the plurality of sensor assemblies, and configured to either:

relay the received data to a recipient, or analyze the received data by monitoring sensor readings over a period of time and emit a signal indicative of a change in readings monitored over said period of time exceeding a predetermined threshold.

* * * * *